US005191305A

United States Patent [19]

Frost et al.

[11] Patent Number: 5,191,305

[45] Date of Patent: Mar. 2, 1993

[54] MULTIPLE BANDPASS FILTER

[75] Inventors: R. Jack Frost, San Juan Capistrano; William G. Erlinger, West Hills, both of Calif.

[73] Assignee: Interstate Electronics Corporation, Anaheim, Calif.

[21] Appl. No.: 725,010

[22] Filed: Jul. 2, 1991

[51] Int. Cl.[5] ..... H01P 1/20

[52] U.S. Cl. ..... 333/202; 333/206; 333/222

[58] Field of Search ..... 333/202, 206, 204, 207, 333/202 DB, 175, 176, 167, 168, 222, 212, 219, 219.1, 227, 228, 230, 231-235, 13, 248, 134-137, 185

[56] References Cited

U.S. PATENT DOCUMENTS

| | | | |
|---|---|---|---|
| 3,737,815 | 6/1973 | Low et al. | 333/202 |
| 4,426,631 | 1/1984 | D'Avello et al. | 333/202 |
| 4,431,977 | 2/1984 | Sokola et al. | 333/206 |
| 4,462,098 | 7/1984 | D'Avello et al. | 333/206 X |
| 4,742,562 | 5/1988 | Kommrusch | 333/134 X |
| 4,823,098 | 4/1989 | DeMuro et al. | 333/206 |

FOREIGN PATENT DOCUMENTS 0200701 8/1989 Japan .

OTHER PUBLICATIONS

G. L. Matthaei, *Microwave Filters, Impedance-Matching Networks, and Coupling Structures*, McGraw-Hill, Inc., 1964, pp. 497-506 and 733, 735 and 737.

R. J. Wenzel, "The Modern Network Theory Approach to Microwave Filter Design," *IEEE Transactions on Electromagnetic Compatibility*, vol. EMC-10, No. 2, Jun. 1968, pp. 196-209.

R. J. Wenzel, "Synthesis of Combline and Capacitively Loaded Interdigital Bandpass Filters of Arbitrary Bandwidth," *IEEE Transactions on Microwave Theory and Techniques*, vol. MTT-19, No. 8, Aug. 1971, pp. 678-686.

J. D. Rhodes, et al., "A Generalized Multiplexer Theory," *IEEE Transactions on Microwave Theory and Techniques*, vol. MTT-27, No. 2, Feb. 1979, pp. 99-111.

R. Levy, et al., "A History of Microwave Filter Research, Design and Development," *IEEE Transactions on Microwave Theory and Technique*, vol. MTT-32, No. 9, Sep. 1984, pp. 1055-1067.

*Primary Examiner*—Paul M. Dzierzynski
*Assistant Examiner*—Ali Neyzari
*Attorney, Agent, or Firm*—Knobbe, Martens, Olson & Bear

[57] ABSTRACT

A multiple bandpass filter is disclosed having a common input intercoupling a plurality of parallel single bandpass filters which are further intercoupled to provide a composite signal at a common output. The multiple bandpass filter of the present invention is appropriate for application to ceramic filters. In a preferred embodiment, the multiple bandpass filter of the present invention has a common input, parallel distributed resonator single bandpass filters, and a common output, all integral to the same ceramic structure. The multiple bandpass filter comprises a ceramic block having a plurality of rows of holes extending from the top of the bottom of the block and a slot extending from the top to the bottom of the block, separating the rows. The block and interior of the holes and slot are substantially covered with conductive material. An area near one end of each of the holes is bare ceramic. The individual rows of holes are the individual single bandpass filters, each hole being a resonator element of the filter. The filters are typically of the combline or intergidital variety. The slot electromagnetically isolates the filters from one another. In a preferred embodiment, the respective ends of the parallel single bandpass filters are each coupled and matched with a common transformer being an additional conductive material covered hole extending from the top to the bottom of the ceramic block.

45 Claims, 6 Drawing Sheets

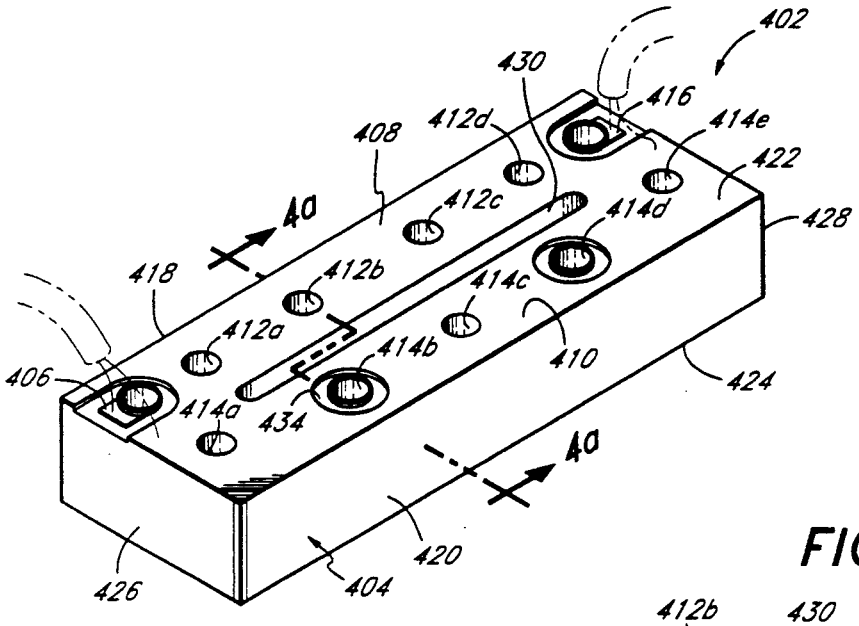
FIG. 4
FIG. 4a
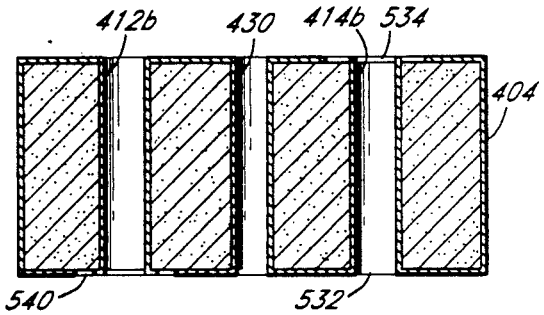
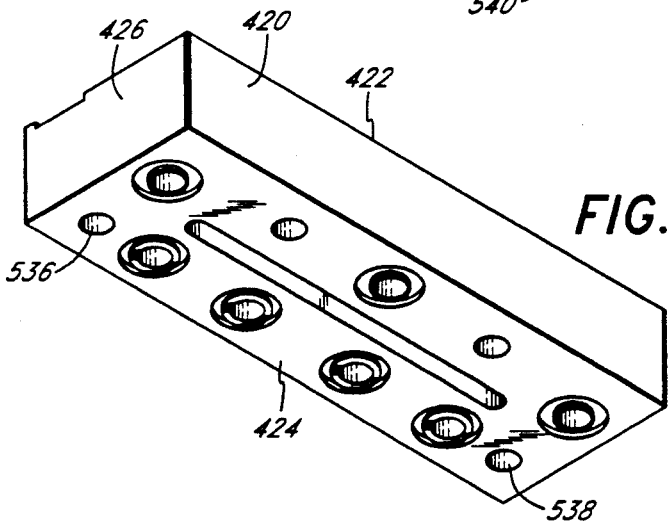
FIG. 5

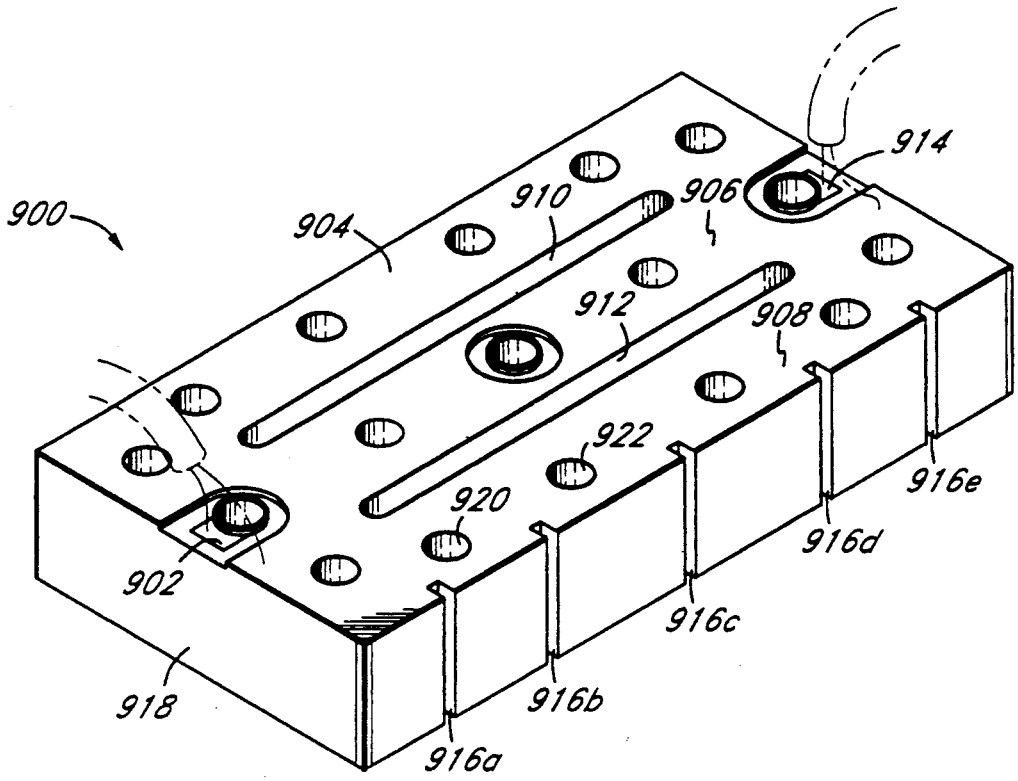
FIG. 9
FIG. 10
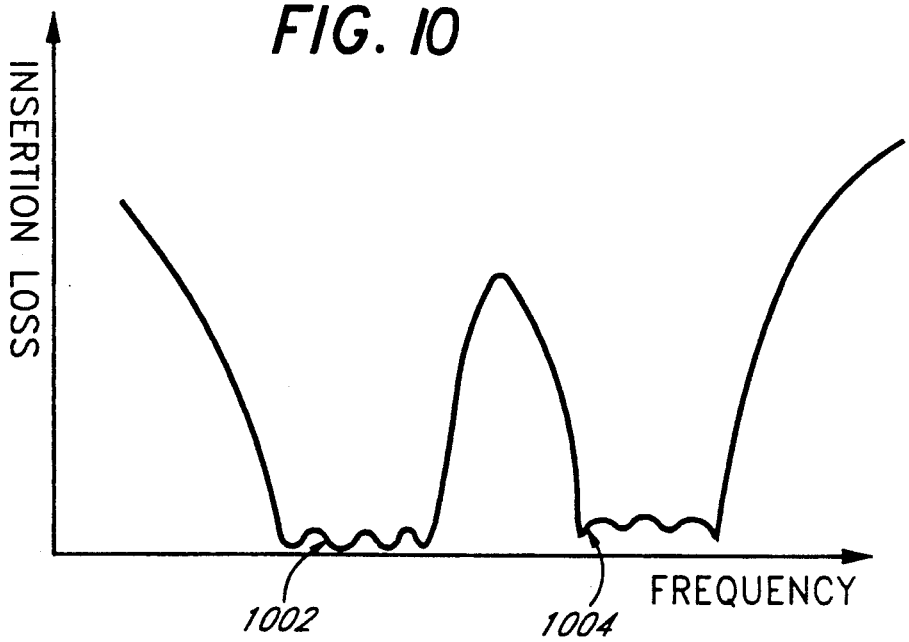

MULTIPLE BANDPASS FILTER

FIELD OF THE INVENTION

The present invention relates to electromagnetic signal filters, and, more particularly, to radio frequency and microwave frequency filters.

BACKGROUND OF THE INVENTION

Conventional distributed multi-resonator radio frequency and microwave signal filters commonly include a plurality of resonators. These resonators typically comprise quarter wavelength or capacitively foreshortened quarter wavelength coaxial or helical resonator bars. The resonators are arranged in a conductive enclosure and are typically coupled to one another by capacitive or inductive means. Iris coupling is often used as a means of adjusting the coupling between the resonators. In these types of multi-resonator filters, tuning screws are commonly required to precisely adjust the frequency of the resonators. The tuning screws can be easily misadjusted, and thus, these types of filters are particularly prone to detuning.

The mechanical problems associated with the tuning screws have been largely solved by ceramic filter technology. Using ceramic filter technology, multi-resonator filters can be constructed in a single dielectric block. The filter typically includes a plurality of metallic cylindrical resonators consisting of metalized holes coupled to one another via the dielectric material. Coupling between the resonators may be adjusted by including decoupling irises or slots, or by varying the size and location of additional metalized or unmetalized holes in the dielectric block. U.S. Pat. Nos. 4,426,631, 4,431,977, and 4,462,098 illustrate exemplary single block ceramic filter designs having multiple inputs and multiple outputs.

Simple multiplexing of ceramic filters in a single block has been shown in U.S. Pat. Nos. 4,431,977 and 4,742,562. However, there are many important applications where it is desirable to provide a common input and a common output for more than one frequency band. For example, a global positioning satellite receiver can require two separate frequency bands from a single output, such as an antenna, so that it may filter the undesired frequencies and then amplify the resulting output signal with a common low noise amplifier. To accomplish this, a dual passband filter without passive dividers or combiners is required. The external transmission lines disclosed in U.S. Pat. No. 4,431,977 may be used for this purpose. However, they are lossy, and can be larger than the filter itself. Further, the external transmission lines must be attached to the filters as a manual process.

OBJECTS OF THE INVENTION

Accordingly, it is an object of the present invention to provide a multiple bandpass filter in a single compact package having a single input and a single output, whereby the multiple bandpass function is achieved without the disadvantages of passive dividers and combiners.

It is another object of the present invention to provide a multiple bandpass filter appropriate for application to ceramic filters.

It is yet another object of the present invention to provide a multiple bandpass filter wherein the multiple bandpass function is achieved by efficiently coupling a plurality of single bandpass filters at their respective inputs and outputs, while still electrically isolating the single bandpass filters from one another.

SUMMARY OF THE INVENTION

The present invention provides a novel and inventive multiple bandpass filter having a common input intercoupling a plurality of single bandpass filters which are further inter-coupled at their outputs to provide a desired composite signal at a common output. The present invention achieves the multiple bandpass functions without the disadvantages of passive dividers and combiners by properly matching both the respective inputs and respective outputs of the single bandpass filters within the structure of the filter.

BRIEF DESCRIPTION OF THE DRAWING

FIG. 4 is a perspective view of a multiple bandpass filter according to the present invention;

FIG. 4*a* is an offset cross-section of FIG. 4 showing hole metalization.

FIG. 5 is a bottom perspective view of the filter of FIG. 4.

FIG. 9 is a perspective view of yet another multiple bandpass filter according to the present invention illustrating an electromagnetic decoupling feature of the present invention;

FIG. 10 illustrates the insertion loss performance between the common input means and common output means of the present invention;

DETAILED DESCRIPTION OF THE PREFERRED EMBODIMENT

Prior Art

Figure 1:
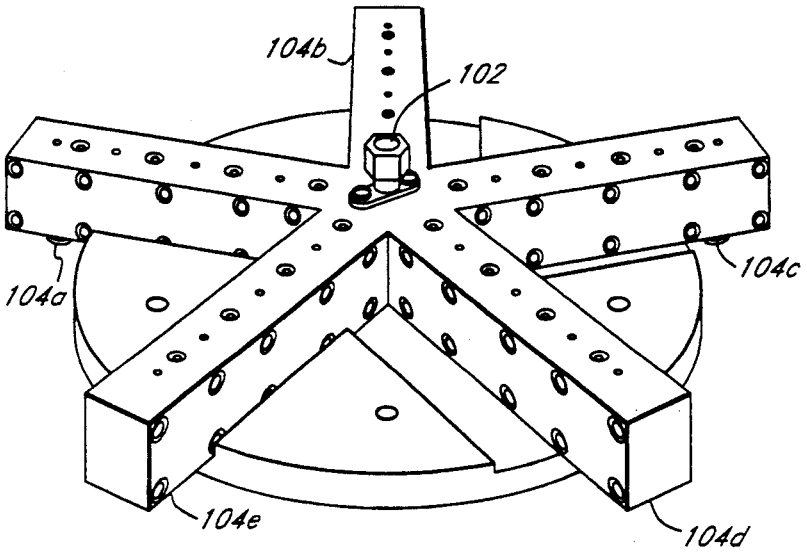
FIG. 1 (PRIOR ART)
FIG. 1 is a perspective view of a multiplexer of the prior art.

FIG. 1 illustrates a multiplexer of the prior art as disclosed in "A Generalized Multiplexer Theory" by J. D. Rhodes and R. Levy, *IEEE Transcript on Microwave Theory and Techniques*Vol. MTT-27, pp. 99–111 (Feb. 1979). In the multiplexer of FIG. 1, a first composite signal is received at an input 102 and signals within particular frequency bands are provided at a plurality of outputs 104*a–e*.

Figure 2:
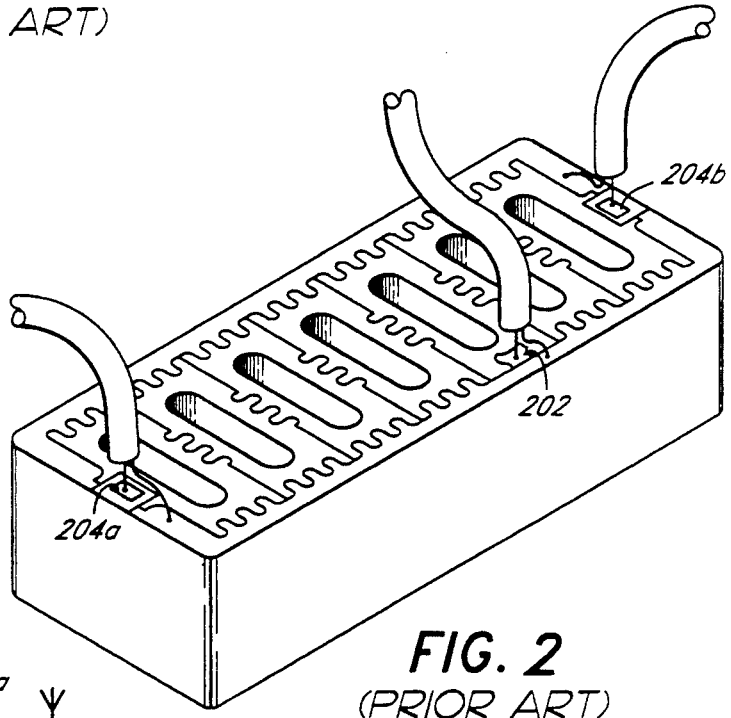
FIG. 2 (PRIOR ART)
FIG. 2 is a perspective view of yet another multiplexer of the prior art.

FIG. 2 illustrates another multiplexer of the prior art as disclosed in U.S. Pat. No. 4,742,562 in which a first composite signal is received at a input 202 and output signals within particular bands are provided at a plurality of outputs 204*a–b*.

Both the multiplexer of FIG. 1 and the multiplexer of FIG. 2 perform the function of isolating certain frequency bands from a composite signal. These multiplexers are incapable, however, of providing a second composite signal comprising the combination of the isolated frequency bands.

Figure 3:
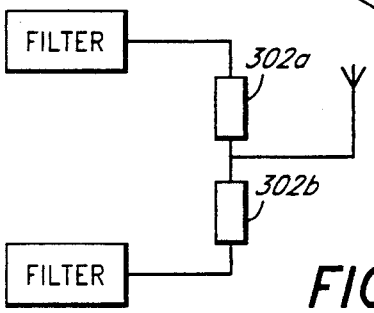
FIG. 3 (PRIOR ART)
FIG. 3 is a schematic of a diplexer of the prior art.

FIG. 3 illustrates a diplexer of the prior art (as disclosed in U.S. Pat. No. 4,431,977) which could be adapted to recombine isolated frequency bands to form a second composite signal. However, the method illustrated in FIG. 3 employs transmission lines 302*a* and *b* which are lossy and occupy substantial space. Moreover, it is necessary to manually interconnect the two outputs with precisely cut lengths of transmission line.

Additionally, passive combiners and dividers which may be adapted to recombine isolated frequency bands are large and therefore unacceptable for many applications.

It is therefore desirable to provide a multiple bandpass filter in a single compact package which avoids the disadvantages of the prior art. A multiple bandpass filter in accordance with the present invention so provides.

Structure of the Preferred Embodiment

FIG. 4 is a top perspective view of a preferred embodiment of a dual pass filter 402 according to the present invention. The filter 402 comprises an input 406 for receiving a first composite electromagnetic signal via a coaxial transmission cable from an antenna (not shown) or other source. The dual pass filter 402 further comprises first and second single bandpass filters, 408 and 410. The single bandpass filters 408 and 410 comprise distributive resonators 412*a–d* and 414*a–e*, respectively. The single bandpass filters 408 and 410 are each coupled to the common input 406 via their nearest resonators, 412*a* and 414*a*, respectively, in FIG. 4. The single bandpass filters each isolate a separate frequency band from the first composite electromagnetic signal. The single bandpass filters further reject unwanted frequency bands.

The filter 402 further includes a common output 416. The common output 416 provides a second electromagnetic signal comprising all of the isolated frequency bands isolated by the single bandpass filters 408 and 410. The common output 416 is coupled to each of the single bandpass filters by their respective nearest resonators, i.e., resonators 412*d* and 414*e* in FIG. 4.

The filter 402 additionally includes a dielectric cavity 404. The dielectric cavity 404 may comprise any particular dielectric material, such as ceramic compounds including barium oxide, titanium oxide, and zirconium oxide. The cavity 404 is substantially covered with an electrically conductive material such as copper, silver or an alloy thereof except for regions around the ends of resonators which are required to be open circuits or capacitively coupled to ground at those ends. The cavity 404 contains the common input, common output and the plurality of single bandpass filters, e.g., 406, 416 and 408 and 410, respectively, in FIG. 4. In an alternative novel and unique preferred embodiment, the cavity 404 may have the common input and the common output disposed thereon. Such an embodiment is described in further detail below.

As shown in the preferred embodiment of FIG. 4, cavity 404 is a ceramic block having a first side 418, a second side 420, a top 422, a bottom 424 (shown on FIG. 5), a first end 426 and a second end 428. In the preferred embodiment of FIG. 4, the first side 418 and the second side 420 are each rectangular and have identical dimensions thereby providing the cavity 404 with a uniform height. Additionally, in the embodiment of FIG. 4, the resonators 412*a–d* and 414*a–e* of single bandpass filters 408 and 410, respectively, comprise metalized holes extending from top 422 to bottom 424 of the ceramic block each of which is connected to the metalized surface of the cavity 402 at one end and open-circuited at the other.

According to the preferred embodiment of the invention shown in FIG. 4, the first single bandpass filter 408 comprises a combline distributed filter having each distributed resonator 412*a–d* coupled to electric ground at the same relative end as described in further detail below. Additionally, according to the embodiment shown in FIG. 4, the second single bandpass filter 410 comprises an interdigital distributed filter having each distributed resonator 414*a–e* coupled to electric ground at alternating ends as described in further detail below.

The design of both combline distributed filters and interdigital distributed filters for isolating individual frequency bands is well-known in the art. Furthermore, it will be understood by one skilled in the art that the plurality of single bandpass filters of the present invention may be any combination of individual distributed filter designs, including all interdigital filters or all combline filters.

The preferred embodiment of the present invention shown in FIG. 4 further includes an electromagnetic isolation means 430. The isolation means 430 electromagnetically isolates the distributed resonators comprising the first and second single bandpass filters 408, 410. In FIG. 4, the resonators 412*a–d* are electromagnetically isolated from the resonators 414*a–e*. In the embodiment of FIG. 4, the isolation means 430 comprises a slot extending from top 422 to bottom 424 disposed between resonators 412*a–d* and resonators 414*a–e*. In the preferred embodiment of FIG. 4, the isolation means 430 is metalized, whereby the surface of the slot may be covered with a conductive material. A cross-section of isolation means 430 is shown in FIG. 4*a*. It will be understood by those skilled in the art that alternative configurations of the isolation means 430, such as a row of metalized holes extending from the top 422 to the bottom 424 disposed between the single bandpass filters (not shown) will serve adequately as an isolation means.

In the preferred embodiment shown in FIG. 4, the common input 406 comprises an input transformer, and the common output means 416 comprises an output transformer. In the exemplary preferred embodiment of FIG. 4, the input and output transformers each comprise single distributed resonators which are metalized holes extending from the top 422 to the bottom 424. The transformer of the input 406 and the transformer of the output 416 are electromagnetically intercoupled to the respective near ends of the first and second single bandpass filter 408, 410 of the multiple bandpass filter 402.

An offset cross-section of the filter 402 is shown in FIG. 4*a*. In FIG. 4*a*, the metal of the input and output transformer resonators and the metal of the distributed resonators of the single bandpass filters is continuous with the conductive material covering the cavity 404 at one end of each hole and discontinuous at the other end. Referring, for example, to the resonator 414*b* in FIG.

4a, the metal of the resonator is continuous with the covering of the cavity 404 at the end 532 and discontinuous at the end 534. The lowered area at the end 434 of FIG. 4 is such a discontinuous portion of the surface of the cavity 404 where conductive covering has been removed or not deposited. Methods for depositing and removing conductive materials and for metalizing holes and covering cavities are well-known in the art. Such methods include vapor deposition, masking and etching techniques.

FIG. 5 shows the bottom view of the preferred embodiment shown in FIG. 4. The continuous ends of the input and output transformers 536 and 538 respectively, are opposite the continuous ends of the filter resonators nearest the transformers. That is, the continuous end 536 is at the bottom 424 while the continuous ends of the nearest resonators 412*a* and 414*a* are at the top 422. Likewise the continuous end 438 is at the bottom 424 while the continuous ends of the nearest resonators 412*d* and 414*e* are at the top 422 as shown in FIG. 4. Such a configuration is known in the art as "opposite-side" transforming. According to another preferred embodiment of the present invention, however, "same-side" transforming may alternately be employed. Such an embodiment is illustrated in FIG. 6.

Figure 6:
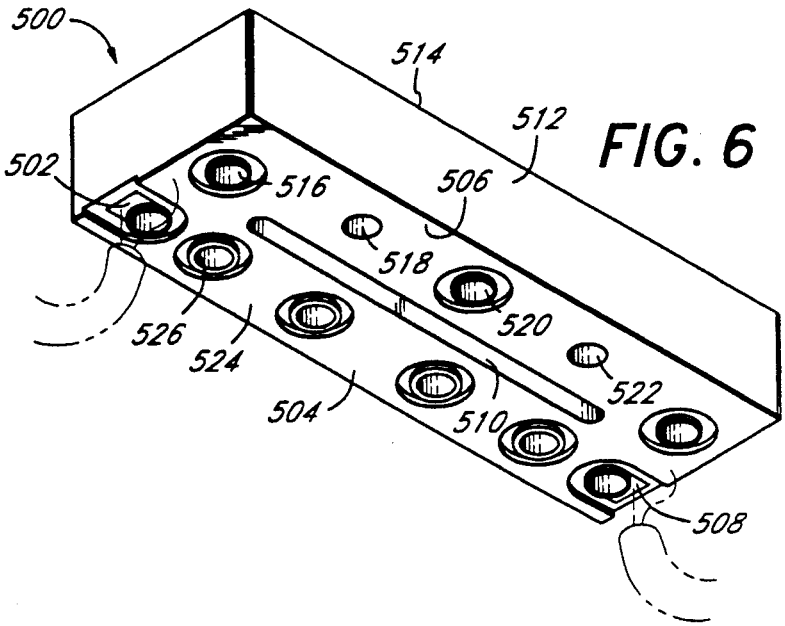
FIG. 6 is a perspective view of another multiple bandpass filter according to the present invention illustrating the same-sided transformer variation of the common input and common output means.

FIG. 6 shows an alternate preferred embodiment of the present invention illustrating "same-side" transforming. A multiple bandpass filter 500 of FIG. 5 comprises a common input 502, a single bandpass filter 504 and a single bandpass filter 506, and a common output 508. The filter 500 of FIG. 6 further comprises an isolation means 510, and a dielectric cavity 512 which is substantially covered with conductive material.

The single bandpass filter 504 comprises a combline filter wherein each resonator is coupled to the electrical ground (i.e., the conductive surface of the cavity) at the same end, (e.g.,the top of the cavity). The coupling is accomplished by positioning all the continuous ends of the resonators along the top surface (not specifically shown).

The single bandpass filter 506 is an interdigital filter wherein each resonator is coupled to the electrical ground at alternating ends. The alternating coupling is accomplished by having the continuous ends of the respective resonators (such as the ends 518 and 522) alternate with the discontinuous ends of adjacent resonators (such as the end 520) along both the top and the bottom surfaces.

The filter 500 of FIG. 6 demonstrates "same-sided" input and output transforming according to the present invention because the discontinuous ends of the input and output transformers of input 502 and output 508, respectively, are on the same side as the discontinuous ends of the respective nearest resonators of the single bandpass filters 504 and 506. For example, the discontinuous end of the input transformer of input 502 is at the bottom 524. Also, the discontinuous end of the nearest resonators 516 and 526 are at the bottom 524.

Figure 7:
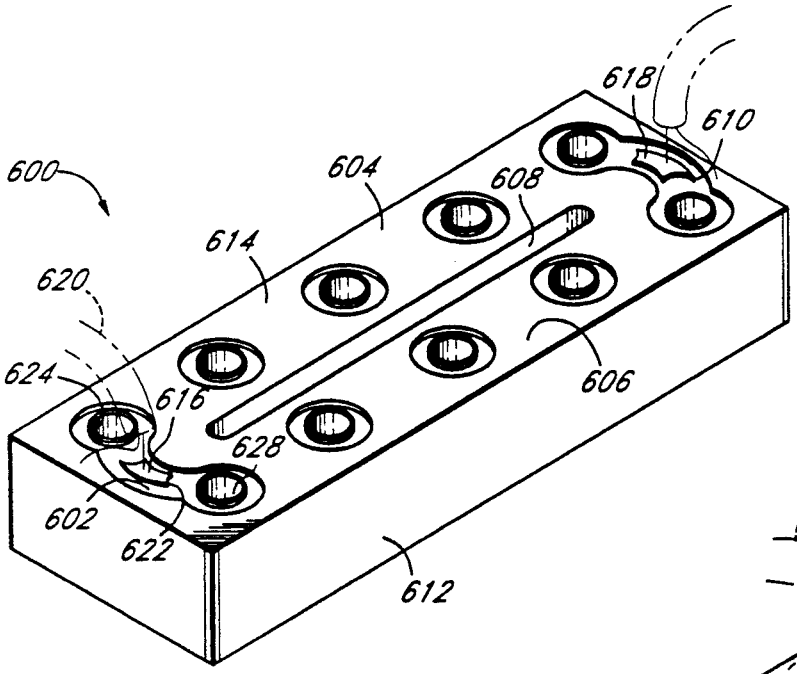
FIG. 7 is a perspective view of yet another multiple bandpass filter according to the present invention illustrating a capacitive coupling variation of the common input and common output means.

The common input means and common output means of the present invention may alternatively comprise electrodes of conductive material. A preferred embodiment incorporating this feature is shown in FIG. 7. A filter 600 of FIG. 7 comprises a common input 602, a single bandpass filter 604, a single bandpass filter 606, an isolation means 608, a common output 610, and a dielectric cavity 612. In the particular embodiment shown in FIG. 7, each single bandpass filter comprises a combline filter. The common input 602 and common output 610 each comprises an electrode of conductive material deposited on the top surface 614 of the cavity 612, specifically an electrode 616 and an electrode 618 respectively.

The particular input electrode configuration 602 of FIG. 7 provides capacitive coupling of a signal provided on coaxial cable 620 to the nearest distributed elements of each single bandpass filter. The capacitive coupling is achieved as a result of the lack of conductive material in the shaded region 622 interposing the electrode 616 and the metalized hole resonators 624 and 628. The coupling of the output 610 functions in an identical manner.

Figure 8:
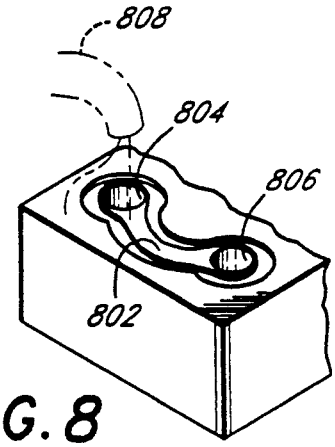
FIG. 8 is a perspective view of an inductive coupling variation of the common input and common output means.

FIG. 8 illustrates an alternative embodiment of a common input and a common output whereby the electrode of the input or the output is inductively coupled to the single bandpass filter. An electrode 802 is a single conductive strip connecting a pair of metalized hole resonators (or transformers) 804 and 806. The resonators 804 and 806 are the first resonators of different single bandpass filters. The continuous conductive strip 802 inductively couples an electromagnetic signal provided on a coaxial cable 808 to the resonators 804 and 806.

It will be understood by one skilled in the art that the common input and common output electrodes of the present invention may be disposed on any side of the dielectric cavity. Additionally, coupling to common input and output transformers may be provided from any of the sides.

When the single bandpass filters of the present invention are designed according to methods known to those skilled in the art, the different single bandpass filters may require different numbers of resonators, different spacing between resonators and different electromagnetic coupling between the resonators. FIG. 9 illustrates a preferred embodiment of the present invention which accommodates the various physical design demands of differing single bandpass means. The filter 900 of FIG. 9 comprises a common input means 902, a first single bandpass filter 904, a second single bandpass filter 906, a third single bandpass filter 908, a first isolation means 910, a second isolation means 912 and a common output 914. The common input means 902 and the common output means 914 are both configured as "opposite-sided" transformers as previously described. The first and third single bandpass filter 904 and 908 are both combline filters. The second single bandpass filter 906 is an interdigital filter. The first and third single bandpass filters 904 and 908 both span longer distances and have more resonators than the second single bandpass filter 906. Accordingly, the common input 902 and the common output 914 are arranged at the respective ends of the second single bandpass filter 906, as shown, while the paths of the first and third single bandpass filters 904 and 908 curve somewhat to meet the common input and common outputs.

The filter 900 of FIG. 9 additionally illustrates an electromagnetic decoupling feature of the present invention. A plurality of grooves 916*a–e* are formed in the sides of a ceramic block 918, extending from the top to the bottom of the block 918. The grooves 916*a–e* decrease the electromagnetic coupling between pairs of adjacent distributed resonators of the third single bandpass filter 908, (e.g,. adjacent resonators 920 and 922). The grooves are an implementation of a scheme known in the art as iris decoupling. It would be understood by those skilled in the art that other implementations, such as holes formed between adjacent resonators, may also be employed. Grooves on the exterior of the cavity should preferably be metalized to prevent the radiation of energy. Holes contained within the cavity may be metalized or unmetalized.

Although preferred embodiments are set forth herein, it will be understood by those skilled in the art that other structural embodiments and variations not specifically illustrated are within the scope of the present invention. Such embodiments may include cavities formed by metal enclosing air, resonators being solid bars or metal strips, and metal strip resonators disposed on flat coplanar surfaces, among others.

Design Theory and Operation

FIG. 10 illustrates the insertion loss performance between the common input and the common output of a preferred embodiment of the present invention. The embodiment yielding the curves of FIG. 10 comprises two single bandpass filters. A region 1002 covers the frequency band isolated by the first single bandpass filter while the region 1004 covers the frequency band isolated by the second single bandpass filter. The first and second single bandpass filters comprise distributed resonators such as the filters 408 and 410 of FIG. 4. As previously described, the filter 408 is of the combline type and the filter 410 is of the interdigital type. However, it will be understood by those skilled in the art that many filter configurations will yield similar insertion loss curves. The complexity of the filters, which is related to the number of resonators in each filter, largely affect the stop band and pass band performance as illustrated by the insertion loss curves of FIG. 10.

Figure 11A:
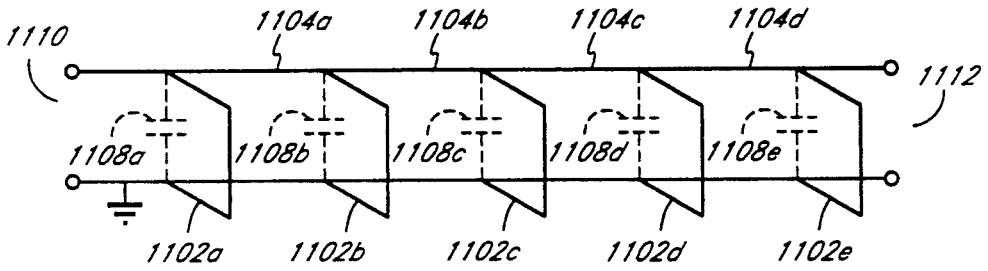
FIG. 11a (PRIOR ART)
FIGS. 11*a* and 11*b* illustrate the simplified equivalent circuit of an interdigital distributed filter.

The interdigital filter 410 has a simplified equivalent circuit shown in FIG. 11*a*. FIG. 11*a* shows a series of short circuited stubs 1102*a–e* cascaded along series transmission lines 1104*a–d*. A simplified distributed interdigital filter familiar to filter designers is shown for clarity in FIG. 11*b*. The short circuited stubs 1102*a–e* represent corresponding metalized holes 414*a–e* of FIG. 4, and similarly the distributed resonators 1106*a–e* of FIG. 11*b*. Each segment of the transmission line 1104*a–d* represents the electromagnetic coupling between adjacent metalized holes 414*a–e* and similarly represent the electromagnetic coupling between the distributed resonators 1106*a–e*.

Figure 11B:
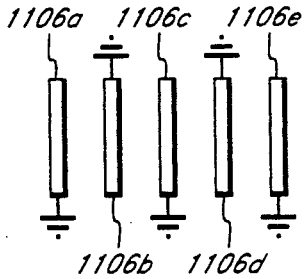
FIG. 11b (PRIOR ART)

Ideally, one end of each resonator of an interdigital filter will be open-circuited as shown in FIG. 11*b*. However, in practice, particularly applied to a ceramic filter as shown in FIG. 4, there will exist a fringing capacitance caused by the discontinuity between the metal of a hole resonator, e.g. resonator 414*b*, and the metal covering of a cavity. Consequently, although not shown in FIG. 11*b*, fringing capacitors 1108*a–e* represent the capacitance across the above-discussed discontinuities, e.g. the region at end 534 of FIG. 4*a*.

Figure 12A:
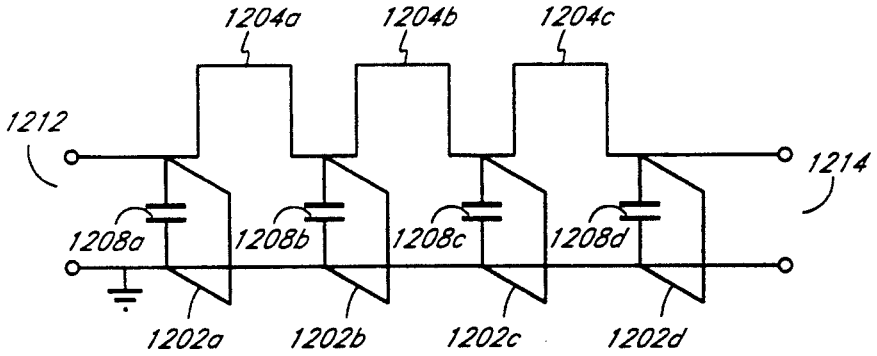
FIG. 12a (PRIOR ART)
FIGS. 12*a* and 12*b* illustrate the simplified equivalent circuit of a combline distributed filter.
Figure 12B:
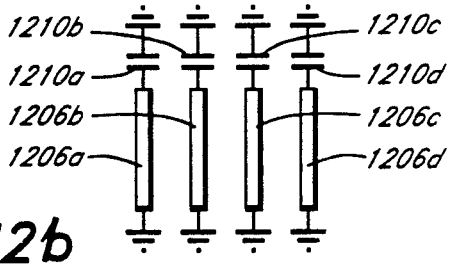
FIG. 12b (PRIOR ART)

The combline filter 408 has the simplified equivalent circuit showing in FIG. 12*a*. FIG. 12*a* shows a series of short circuited stubs 1202*a–d* alternately cascaded with short circuited stubs 1204*a–c*. A simplified distributed combline filter familiar to filter designers is shown for clarity in FIG. 12*b*. The short circuit stub 1202*a–d* represent corresponding metalized holes 412*a–d* of FIG. 4, and similarly represent the distributed resonators 1206*a–d* of FIG. 12*b*. Each short circuited stub 1204*a–c* represents the electromagnetic coupling between adjacent metalized holes 412*a–d* and similarly represents the electromagnetic coupling between the distributed resonators 1206*a–d*.

In the case of combline filters, one end of each distributed resonator is capacitively coupled to ground. The capacitors 1208*a–d* of FIG. 12*a* represent the capacitive coupling of the metalized holes 412*a–d* of FIG. 4 to the conductive cavity covering, (i.e., to the electric ground). This capacitive coupling is caused by discontinuous regions such as region 540 of FIG. 4*a*. Similarly, the capacitors 1208*a–d* represent the capacitors 1210*a–d* shown in FIG. 12*b*. The capacitance represented by capacitors 1208*a–d* are tunable as implemented in the filter 408 of FIG. 4 by adding or removing metal in the region 440 of FIG. 4*a*.

The design and implementation of the filters represented in FIGS. 11*a*, 11*b*, 12*a* and 12*b* are well-known in the art. A filter similar to that represented in FIG. 12*a*, for example, is shown in U.S. Pat. No. 4,431,977. A significant inventive feature of the present invention, however, is providing a plurality of such filters in parallel in the same structure. It is not sufficient to merely connect such filters in parallel at ports 1110 and 1212 and further at ports 1112 and 1214, for example, since the out-of-band admittance of each filter is seen as an unwanted admittance relative to the passband of the other filter. These unwanted admittances result in severe mismatches. Consequently, the input and output ports must be appropriately matched.

Two methods for providing the matching required by the present invention are: (1) multiplexing both the input and output ports of the multiple bandpass filter; and (2) using computer optimization software operating on equivalent circuits of the initial design of the multiple bandpass filter. Both methods operate on an equivalent circuit of the multiple bandpass filter, and therefore depend upon the choice of port coupling among the individual filters. For example, the filter 600 of FIG. 7 couples the individual single bandpass filters capacitively with the capacitive common input 602. Alternatively, the input coupling of FIG. 8 is inductive. Additionally, according to the preferred embodiments shown in FIGS. 4, 6 and 9, the plurality of individual filters may be commonly coupled with a common transformer.

Figure 13A:
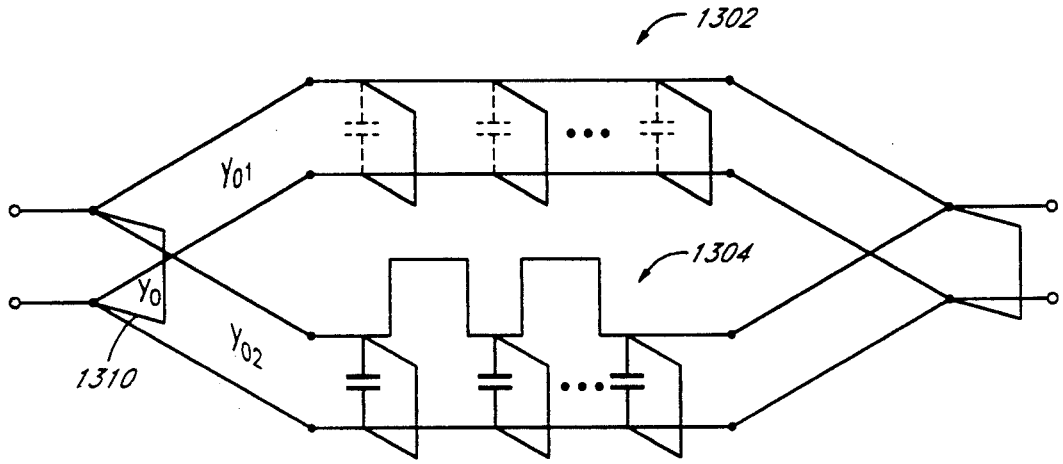
FIGS. 13*a* and 13*b* illustrate a simplified equivalent circuit of common transformer coupling of parallel distributed circuits.
Figure 13B:
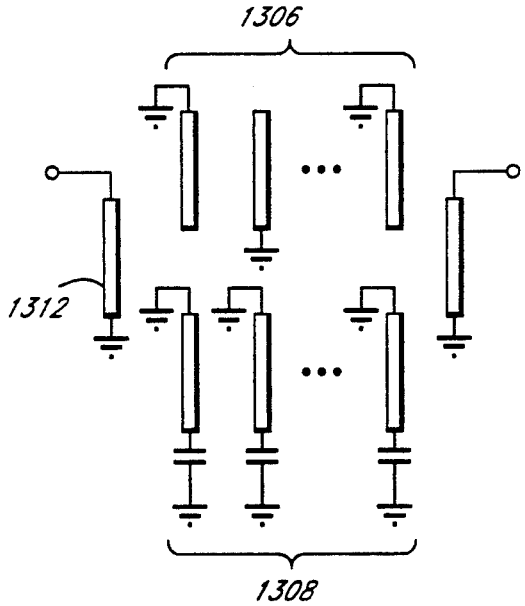

FIG. 13*a* shows a simplified equivalent circuit of a preferred embodiment of the present invention wherein the particular coupling scheme is a common transformer. FIG. 13*b* shows a simplified distributed resonator common transformer arrangement familiar to filter designers. A section 1302 of FIG. 13*a* and a section 1306 of FIG. 13*b* represent the resonators of the filter of FIGS. 11*a* and *b*, respectively. Similarly, a section 1304 of FIG. 13*a* and a section 1308 of FIG. 13*b* represent the resonators of the filter of FIGS. 12*a* and *b*, respectively. A section 1310 of FIG. 13*a* and resonator 1312 of FIG. 13*b* represent the simplified equivalent circuit of a common matching transformer.

The common transformer is seen to provide connections to the first resonator of each filter in the form of transmission lines of admittance $Y_{01}$ and $Y_{02}$ respectively, as shown. The input is shunted by a shorted stub of admittance $Y_0$, and is taken into account in the design using techniques which are well-known to filter engineers. One such technique involves a use of nodal admittance transformations which replace an initially 0 value of $Y_0$ with a finite value after the equivalent circuit transformation. This procedure is described in detail in "A Generalized Multiplexer Theory", cited above.

Once the common input and output coupler scheme has been chosen, be they capacitive, inductive, or common transformer, either multiplexing theory, as described further below, or computer optimization may be employed. Both methods operate on an initial equivalent circuit. Either process will typically alter the element values associated with the coupling and the first one or two resonators of each parallel filter. The modified element values will translate to physical specifications for implementations such as the preferred embodiments described herein.

The multiple bandpass may be designed as a double multiplexer. Here the multiplexing method may use one of the many available theories and techniques, for example, that are described in "A Generalized Multiplexer Theory." These invariably change the parameters of mainly the first one or two resonators. Hence, it is simple to make the same changes to the output connection of the multiple bandpass structure, and the multiple bandpass structure becomes matched.

In the "Generalized Multiplexer Theory," the input admittance at the common port of the multiplexer is expressed as a power series expansion in terms containing the element values of the doubly terminated filters and the frequency spacing between &:he two center frequencies. The latter is an important component of the series expansion, since as the frequency spacing tends to infinity, the filter elements are asymptotic to the doubly terminated values. The doubly terminated element values are perturbed by factors which are inversely proportional to the frequency separation of the channels. A set of equations may then be set down expressing the condition for rematching the passbands. Fortunately, this set of simultaneous equations has a simple closed-form solution which gives good results in almost all cases.

The multiple bandpass structure is obtained when the multiplexing is introduced similarly at the output end. This process may be termed "double-multiplexing" and the parallel filter group may be described as having been doubly multiplexed.

The common input and common output match may alternatively be designed using computer optimization techniques operating on the equivalent circuit. Given the equivalent circuits of the filters and their common transformers, where applicable, at each end, it is a straight forward matter to analyze the overall two port structure using a general analysis program, e.g. Touchstone or Super-Compact, available from EESOF and COMSAT GENERAL, respectively. These programs provide users with an optimization facility in order to improve the performance of the circuit to meet some specified set of parameters. In the present case, the two filters are designed initially as conventional doubly terminated filters which may have a common transformer connection. Each filter will be mismatched to some extent by the shunt connection of the other filter. This may be corrected by allowing the coupling and resonant circuit parameters of the first two resonators at each of end of the dual passband filter to be variables in the optimization process. The designer specifies the range over which the parameters are allowed to vary, and instructs the computer to optimize the performance to given specifications, most importantly that the filters should be matched to the port terminations over the two passbands. There is rarely any problem in having this process converge after a few iterations.

Whatever design method is used, the resulting element values will translate to physical specifications of the filter understood by those skilled in the art. The specifications include, resonator diameter, inter-resonator spacing, spacing between resonators and ground plane walls or isolation means, dimensions of capacitive termination of resonators, and dielectric cavity material.

One preferred embodiment of the present invention provides a dual bandpass filter having uniform width, length and height. The embodiment employs one interdigital filter and one combline filter. The interdigital filter is first designed to have a higher frequency passband than the combline filter. The resonator height required for the interdigital filter establishes the height of the filter. The combline filter is then designed, and, where longer electrical lengths for the resonators are indicated, the resonators are physically foreshortened by altering the resonators with capacitive loading. The filter length and width can also be affected by electromagnetic decoupling such as the grooves shown in FIG. 9.

It will be understood by those skilled in the art that various modifications and changes may be made to the present invention and embodiments described herein without departing from the spirit and scope thereof.

What is claimed is:

1. A multiple bandpass filter comprising:

a common input for receiving a first composite electromagnetic signal, said common input comprising an input transformer comprising a distributed resonator;

a plurality of single bandpass filters, each having a first and a second end and each having a different frequency passband, each single bandpass filter coupled at its first end to said common input, wherein each of said plurality of single bandpass filters isolates its respective frequency passband from said first composite electromagnetic signal and provides rejection to unwanted frequency bands, each of said plurality of single bandpass filters comprising at least one distributed resonator;

a common output coupled to said second ends of said plurality of signal bandpass filters for providing a second composite electromagnetic signal comprising each of said isolated frequency passbands, said common output comprising an output transformer comprising a distributed resonator; and a single common structure, having a uniform length, a uniform width and a uniform height, said single common structure containing said common input, said plurality of single bandpass filters, and said common output integral thereto.

2. A filter according to claim 1, wherein each of said plurality of single bandpass filters comprise an interdigital filter.

3. A filter according to claim 1, wherein each of said plurality of single bandpass filters comprise a combline filter.

4. A filter according to claim 1, wherein at least one of said plurality of said bandpass filters comprises an interdigital filter and at least one single bandpass filters comprise a combline filter.

5. A filter according to claim 4, wherein the frequency band isolated by said interdigital filter is higher than the frequency band isolated by said combline filter.

6. A filter according to claim 1, wherein said common input comprises an electrode, said electrode comprising deposited conductive material.

7. A filter according to claim 1, wherein said common output comprises an electrode, said electrode comprising deposited conductive material.

8. A filter according to claim 1, wherein said common input and said common output comprise electrodes, said electrodes comprising deposited conductive material.

9. A filter according to claim 8, wherein said electrodes are configured for providing capacitive coupling of said first and second composite electromagnetic signals to said first and second ends, respectively, of said plurality of single bandpass filters.

10. A filter according to claim 8, wherein said electrodes are configured for providing inductive coupling of said first and second composite electromagnetic signals to said first and second ends, respectively, of said plurality of single bandpass filters.

11. A multiple bandpass filter comprising:

a common input for receiving a first composite electromagnetic signal, said common input comprising an input transformer comprising a distributed resonator;

a plurality of single bandpass filters, each having first and second ends and each having a different frequency passband, each single bandpass filter coupled at said first end to said common input, each of said plurality of single bandpass filters isolates its respective frequency passband from said first composite electromagnetic signal, and providing rejection to unwanted frequency bands, each of said plurality of single bandpass filters comprising at least one distributed resonator;

a common output coupled to each of said second ends of said plurality of single bandpass filters, for providing a second composite electromagnetic signal comprising each of said isolated frequency passbands, said common output comprising an output transformer comprising a distributed resonator; and a single dielectric cavity substantially covered with electrically conductive material, having a uniform length, a uniform width and a uniform height, said single dielectric cavity having said common input and said common output disposed thereon and containing said plurality of said single bandpass filters.

12. A filter according to claim 11, wherein each of said plurality of single bandpass filters comprise an interdigital filter.

13. A filter according to claim 11, wherein each of said plurality of single bandpass filters comprise a combline filter.

14. A filter as claimed in claim 11, wherein at least one of said plurality of single bandpass filters comprises an interdigital filter and at least one different single bandpass filters comprises a combline filter.

15. A filter according to claim 14, wherein the frequency band isolated by said interdigital filter is higher than the frequency band isolated by said combline filter.

16. A filter according to claim 11, wherein said common input comprises an electrode, said electrode comprising deposited conductive material.

17. A filter according to claim 11, wherein said common output comprises an electrode, said electrode comprising deposited conductive material.

18. A filter according to claim 11, wherein said common input and said common output comprise electrodes, said electrodes comprising deposited conductive material.

19. A filter according to claim 18, wherein said electrodes are configured for providing capacitive coupling of said first and second composite electromagnetic signals to said first and second ends, respectively, of said plurality of said single bandpass filters.

20. A filter according to claim 18, wherein said electrodes are configured for providing inductive coupling of said first and second composite electromagnetic signals to said first and second ends, respectively, of said plurality of said single bandpass filters.

21. A filter according to claim 11, wherein said dielectric cavity comprises a ceramic block having first and second sides, a top, a bottom, a first end and a second end, said distributed resonators of said single bandpass filters comprising metalized holes extending from the top to the bottom of said block.

22. A filter according to claim 21, further comprising at least one isolation means for electromagnetically isolating said distributed resonators of different ones of said plurality of single bandpass filters.

23. A filter according to claim 22, wherein said isolation means comprises a slot extending from the top to the bottom of said block disposed between said distributed resonators of different ones of said plurality of single bandpass filters.

24. A filter according to claim 23, wherein said slot is metalized.

25. A filter according to claim 21, wherein said block first and second sides are rectangular and have identical dimensions so as to provide said block with a uniform height.

26. A filter according to claim 21, further comprising decoupling means for decreasing the electromagnetic coupling between pairs of adjacent distributed resonators of at least one particular single bandpass filter, said decoupling means comprising a groove formed in the side of said block nearest said particular single bandpass filter, extending from the top to the bottom of said block, disposed between said pairs of adjacent resonators.

27. A multiple bandpass filter comprising:

a common input for receiving a first composite electromagnetic signal, said common input comprising an input transformer comprising a distributed resonator;

a plurality of single bandpass filters, each having first and second ends and each having a different frequency passband, each single bandpass filter coupled at said first end to said common input, wherein each of said plurality of single bandpass filters isolates its respective frequency passband from said first composite electromagnetic signal and provides rejection to unwanted frequency bands, each of said plurality of single bandpass filters comprising at least one distributed resonator;

a common output coupled to each of said second ends of said plurality of single bandpass filters, for providing a second composite electromagnetic signal comprising each of said isolated frequency passbands, said common output comprising an output transformer comprising a distributed resonator; and a single dielectric cavity substantially covered with electrically conductive material, having a uniform length, a uniform width and a uniform height, said single dielectric cavity containing said common input, common output, and said plurality of said single bandpass filters.

28. A filter according to claim 27, wherein each of said plurality of single bandpass filters comprise an interdigital filter.

29. A filter according to claim 27, wherein each of said plurality of single bandpass filters comprise a combline filter.

30. A filter according to claim 27, wherein at least of one of said plurality of single bandpass filters comprises an interdigital filter and at least one different single bandpass filters comprises a combline filter.

31. A filter according to claim 30, wherein the frequency band isolated by said interdigital filter is higher than the frequency band isolated by said combline filter.

32. A filter according to claim 27, wherein said dielectric cavity comprises a ceramic block having first and second sides, a top, a bottom, a first end and a second end, said distributed resonators of said single bandpass filters comprising metalized holes extending from the top to the bottom of said block.

33. A filter according to claim 32, further comprising at least one isolation means for electromagnetically isolating said distributed resonators of different ones of said plurality of single bandpass filters.

34. A filter according to claim 33, wherein said isolation means comprises a slot extending from the top to the bottom of said block disposed between said distributed resonators of different ones of said plurality of single bandpass filters.

35. A filter according to claim 34, wherein said slot is metalized.

36. A filter according to claim 32, wherein said block first and second sides are rectangular and have identical dimensions so as to provide said block with a uniform height.

37. A filter according to claim 32, further comprising decoupling means for decreasing the electromagnetic coupling between pairs of adjacent distributed resonators of at least one particular single bandpass filter, said decoupling means comprising a groove formed in the side of said block nearest said particular single bandpass filter, extending from the top to the bottom of said block, disposed between said pairs of adjacent resonators.

38. A filter according to claim 27, wherein said input transformer and said output transformer are for electromagnetically intercoupling said first ends and said second ends, respectively, of said plurality of single bandpass filters.

39. A filter according to claim 32, wherein said common input comprises an input transformer and said common output comprises an output transformer said input and output transformer each comprising a distributed resonator being a metalized hole extending from the top to the bottom of said block.

40. A filter according to claim 39, wherein the metal of the metalized holes of said input and output transformers and the metal of the metalized holes of said distributed resonators of said plurality of single bandpass filter is continuous with the conductive material covering said dielectric cavity at one end of said holes, and discontinuous at the other end of said holes, and further wherein the continuous ends of said input and output transformers are relatively opposite the continuous ends of the nearest distributed resonators of said plurality of single bandpass filters.

41. A filter according to claim 39, wherein the metal of the metalized holes of said input and output transformers and said distributed resonators of said plurality of single bandpass filters is continuous with the conductive material covering said dielectric cavity at one end of said holes, and discontinuous at the other end of said holes, and further wherein the continuous ends of said input and output transformers are on the same relative ends as the continuous ends of the nearest distributed resonators of said plurality of single bandpass filters.

42. A multiple bandpass filter comprising:

a common input for receiving a first composite electromagnetic signal;

a plurality of single bandpass filters, each having first and second ends, each coupled at said first end to said common input, each of said plurality of single bandpass filters isolating a frequency band from said first composite electromagnetic signal and providing rejection to unwanted frequency bands, each of said plurality of single bandpass filters comprising at least one distributed resonator;

a common output coupled to each of said second ends of said plurality of single bandpass filters to provide a second composite electromagnetic signal comprising each of said isolated frequency bands;

a dielectric cavity substantially covered with electrically conductive material, said cavity containing said common input, common output, and said plurality of said single bandpass filters;

wherein said common input comprises an input transformer and said common output comprises an output transformer, said input transformer and said output transformer each comprising a distributed resonator; and wherein said input transformer and said output transformer electromagnetically intercouple said first ends and said second ends, respectively, of said plurality of single bandpass filters.

43. A multiple bandpass filter comprising:

a common input for receiving a first composite electromagnetic signal;

a plurality of single bandpass filters, each having first and second ends, each coupled at said first end to said common input, each of said plurality of single bandpass filters isolating a frequency band from said first composite electromagnetic signal and providing rejection to unwanted frequency bands, each of said plurality of single bandpass filters comprising at least one distributed resonator;

a common output coupled to each of said second ends of said plurality of single bandpass filters to provide a second composite electromagnetic signal comprising each of said isolated frequency bands;

a dielectric cavity substantially covered with electrically conductive material, said cavity containing said common input, common output, and said plurality of said single bandpass filters;

wherein said dielectric cavity comprises a ceramic block having first and second sides, a top, a bottom, a first end and a second end, said distributed resonators of said single bandpass filters comprising metalized holes extending from the top to the bottom of said block; and wherein said common input comprises an input transformer and said common output comprises an output transformer, said input transformer and said output transformer each comprising a distributed resonator being a metalized hole extending from the top to the bottom of said block.

44. A filter according to claim 43, wherein the metal of the metalized holes of said input and output transformers and the metal of the metalized holes of said distributed resonators of said plurality of single bandpass filters is continuous with the conductive material covering said dielectric cavity at one end of said holes, and discontinuous at the other end of said holes, and wherein the continuous ends of said input and output transformers are relatively opposite the continuous ends of the nearest distributed resonators of said plurality of single bandpass filters.

45. A filter according to claim 43, wherein the metal of the metalized holes of said input and output transformers and said distributed resonators of said plurality of single bandpass filters is continuous with the conductive material covering said dielectric cavity at one end of said holes, and further wherein the continuous ends of said input and output transformers are on the same relative ends as the continuous ends of the nearest distributed resonators of said plurality of single bandpass filters.

* * * * *

UNITED STATES PATENT AND TRADEMARK OFFICE

CERTIFICATE OF CORRECTION

PATENT NO. : 5,191,305

DATED : March 2, 1993

INVENTOR(S) : R. Jack Frost, et al

It is certified that error appears in the above-indentified patent and that said Letters Patent is hereby corrected as shown below:

At Column 11, Line 30, change "isolates" to --isolating--.

At Column 14, Line 53, change "to provide" to --that provides--".

Signed and Sealed this

Sixteenth Day of November, 1993

*Attest:*

*Attesting Officer*

BRUCE LEHMAN

*Commissioner of Patents and Trademarks*